US010213075B2

(12) United States Patent
Shin et al.

(10) Patent No.: US 10,213,075 B2
(45) Date of Patent: Feb. 26, 2019

(54) VACUUM CLEANER

(71) Applicant: LG Electronics Inc., Seoul (KR)

(72) Inventors: Jinhyouk Shin, Seoul (KR); Jungwan Ryu, Seoul (KR); Moohyun Ko, Seoul (KR); Sungjun Kim, Seoul (KR); Minseong Kim, Seoul (KR); Ingyu Yang, Seoul (KR); Jaehun Han, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/599,973

(22) Filed: May 19, 2017

(65) Prior Publication Data

US 2017/0332856 A1 Nov. 23, 2017

(30) Foreign Application Priority Data

May 20, 2016 (KR) ..... 10-2016-0062338
May 20, 2016 (KR) ..... 10-2016-0062375

(51) Int. Cl.

| | |
|---|---|
| ***A47L 9/28*** | (2006.01) |
| ***A47L 5/36*** | (2006.01) |
| ***A47L 9/00*** | (2006.01) |
| ***A47L 9/24*** | (2006.01) |
| *A47L 5/22* | (2006.01) |
| *A47L 5/32* | (2006.01) |

(52) U.S. Cl.

CPC ..... *A47L 5/362* (2013.01); *A47L 5/365* (2013.01); *A47L 9/009* (2013.01); *A47L 9/242* (2013.01); *A47L 9/2805* (2013.01); *A47L 9/2852* (2013.01); *A47L 5/22* (2013.01); *A47L 5/32* (2013.01)

(58) Field of Classification Search

CPC ... A47L 5/362; A47L 5/22; A47L 5/32; A47L 5/365; A47L 9/009; A47L 9/242; A47L 9/2805; A47L 9/2852

IPC ..... A47L 9/28

See application file for complete search history.

(56) References Cited

U.S. PATENT DOCUMENTS

| | | | | |
|---|---|---|---|---|
| 8,613,125 | B2 * | 12/2013 | Jeong | A47L 5/362 15/319 |
| 2009/0038107 | A1 * | 2/2009 | Tiekoetter | A47L 5/362 15/339 |
| 2016/0235268 | A1 * | 8/2016 | Choi | A47L 9/2857 |

FOREIGN PATENT DOCUMENTS

| | | |
|---|---|---|
| JP | 2009022403 | 2/2009 |
| KR | 200147254 | 3/1999 |
| KR | 10-2004-0105164 | 12/2004 |
| KR | 10-0876696 | 11/2008 |
| KR | 100901032 | 5/2009 |
| KR | 10-2016-0024498 | 3/2016 |

* cited by examiner

*Primary Examiner* — David Redding
(74) *Attorney, Agent, or Firm* — Fish & Richardson P.C.

(57) ABSTRACT

A vacuum cleaner includes a cleaner body that includes a suction motor, wheels that are configured to move the cleaner body, a driving motor that is configured to drive the wheels, a suction unit that is configured to communicate with the cleaner body, a connector coupled to the suction unit, the connector being rotatably connected to the cleaner body, a sensor that is disposed on the connector and configured to sense a movement of the connector, an elastic member that is configured to provide an elastic force to the connector toward an initial position of the connector, and a controller that is configured to control the driving motor based on movement information sensed by the sensor.

20 Claims, 9 Drawing Sheets

VACUUM CLEANER

CROSS-REFERENCE TO RELATED APPLICATIONS

This application claims priority under 35 U.S.C. § 119 to Korean Patent Application No. 10-2016-0062338, filed in Korea on May 20, 2016, and Korean Patent Application No. 10-2016-0062375, filed in Korea on May 20, 2016, whose entire content is incorporated herein by reference.

TECHNICAL FILED

The present disclosure relates to a vacuum cleaner.

BACKGROUND

In general, a vacuum cleaner is a device that sucks dust and dirt on surfaces to be cleaned, using a suction motor in the main body, and then filters the dust and dirt in the main body.

Vacuum cleaners can be classified into an upright vacuum cleaner in which a suction nozzle is connected to the main body to be moved with the main body and a canister vacuum cleaner in which a suction nozzle is connected to the main body through an extension, a handle, and a hose, etc.

An "active type driving vacuum cleaner" has been disclosed in Korean Patent NO. 10-0876696 in the related art. The cleaner in this prior art document controls its body by sensing operation by a user through the speed (or acceleration) at a specific position or the relative speed (or relative acceleration) between two specific positions in the body.

The cleaner in the prior art document includes: a body having a rotational center; wheels for moving the body; a driving unit for operating the wheels, a suction hose coupler coupled to the body at a predetermined distance from the rotational center; at least one sensor sensing the movement speed of the rotational center through movement of the suction hose coupler; and a controller controlling the driving unit on the basis of sensing information from the sensor.

In detail, according to the active type driving vacuum cleaner in the prior art document, when the body inclines forward, the inclination is sensed and the driving unit is controlled such that the body moves forward, whereby the cleaner automatically follows movement of a user. Accordingly, the main body has to incline in order to automatically follow movement of a user.

However, several parts including a suction motor are disposed in the main body of cleaners, so the weight is increased and the moment of inertia is accordingly large. Accordingly, a user has to apply relatively large force to incline the body of cleaners and it is difficult to follow fine movement of a user.

Further, according to the active type driving vacuum cleaner in the prior art document, the main body may incline and move forward regardless of user's intention, for example, due to twist of the suction hose.

Further, according to the active type driving vacuum cleaner in the prior art document, when a user moves back, the main body may excessive incline and fall down.

SUMMARY

The present disclosure provides a vacuum cleaner that allows a user to apply minimum for to move the cleaner body and controls the cleaner body to move in accordance with the user's intention.

The present disclosure provides a vacuum cleaner that has an active operation function and is not turned over while being moved backward.

A vacuum cleaner includes: a cleaner body that has a suction motor; wheels that are configured to move the cleaner body; a driving motor that is configured to operate the wheels; a suction unit that communicates with the cleaner body; a connector that is rotatably connected to the cleaner body and coupled to the suction unit; a sensor that is disposed on the connector to sense movement of the connector; an elastic member that provides torque to the connector to move the connector to an initial position; and a controller that is configured to control the driving motor on a basis of sensing information from the sensor.

DETAILED DESCRIPTION OF THE EMBODIMENTS

Figure 1:
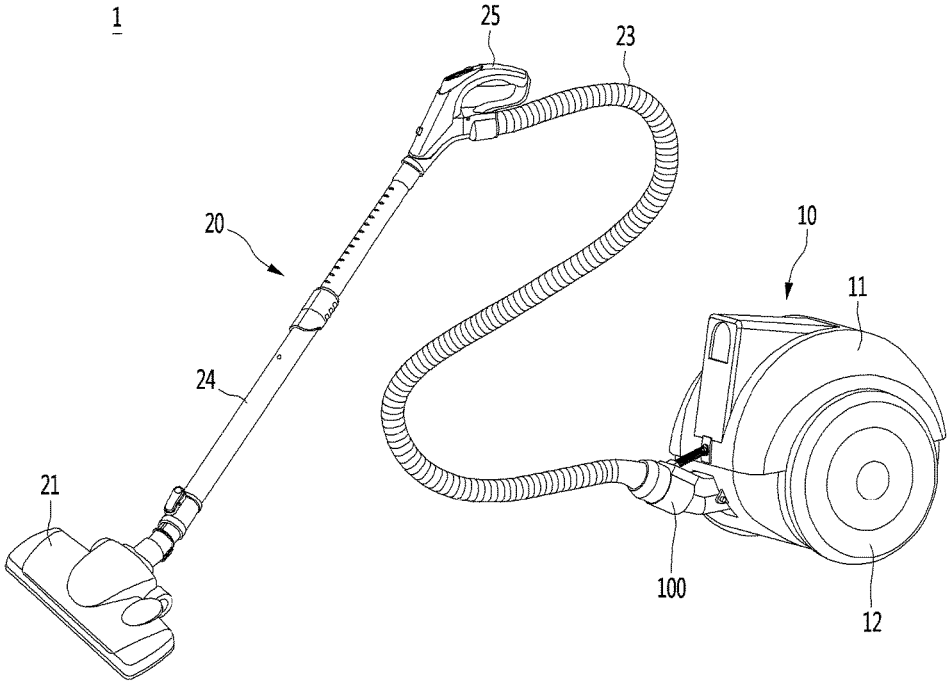
FIG. 1 is a perspective view of a vacuum cleaner according to an embodiment of the present invention.
Figure 2:
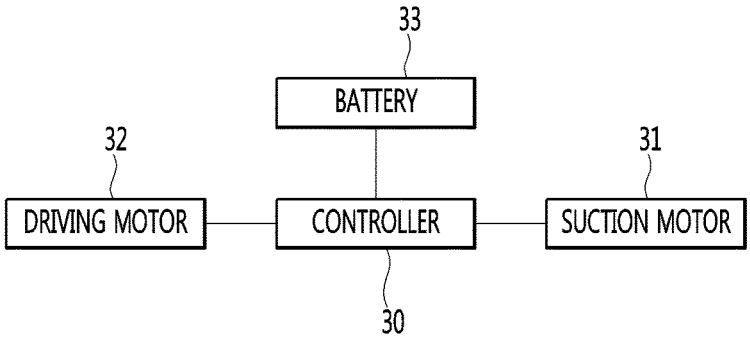
FIG. 2 is a block diagram of the vacuum cleaner according to an embodiment of the present invention.

FIG. 1 is a perspective view of a vacuum cleaner according to an embodiment of the present invention and FIG. 2 is a block diagram of the vacuum cleaner according to an embodiment of the present invention.

Referring to FIGS. 1 and 2, a vacuum cleaner 1 according to an embodiment of the present invention includes a cleaner body 10 having a suction motor 21 generating a suction force and a suction unit 20 connected to the cleaner body 10 to suck air and dirt on the floor.

The suction unit 20 may include a suction nozzle 21 that can move on the floor and a connecting unit for connecting the suction nozzle 21 to the cleaner body 10.

The connecting unit may include an extension pipe 24 connected to the suction nozzle 21, a handle 25 connected to the extension pipe 24, and a connecting hose 23 connecting the handle 25 to the cleaner body 10.

The cleaner body 10 may include a body unit 11 and one or more wheels 12 coupled to the body unit 11.

The cleaner body 10 may include a driving motor 32 for driving the wheels 12 and a controller 30 that controls the driving motor 32. Further, the cleaner body 10 may include a battery 33 that supplies power to the driving motor 32 and the controller 30.

The controller can control the driving motor so that the cleaner body 10 can automatically follow movement of a user. The automatic following will be described below after FIG. 4.

The cleaner body 10 may further include a connector 100 to which the suction unit 20 is connected.

The connecting hose 23 may be connected to the connector 100. Accordingly, air sucked into the connecting hose 23 can flow into the body unit 11 through the connector 100.

The body unit 11 may include a dust bag (not shown) that keeps dust separated from air. The connector 100 may communicate with the dust bag through a guide pipe (not shown) in the body unit 11.

The function of the connector 100 is described in detail hereafter.

Figure 3:
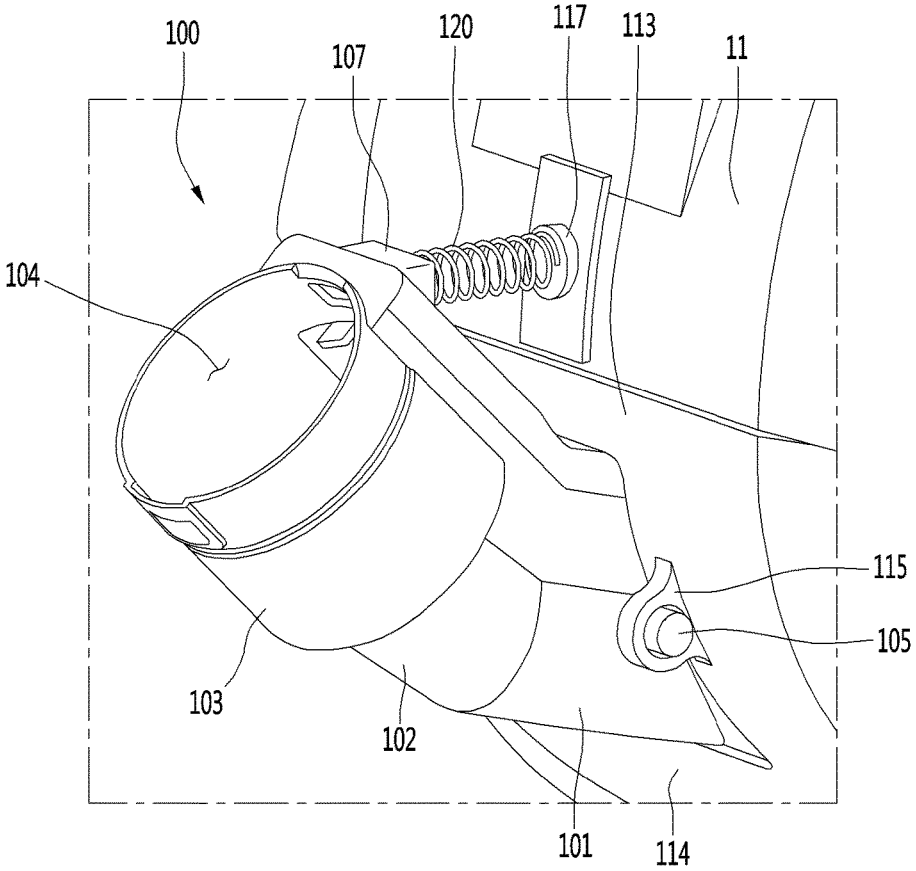
FIG. 3 is a view showing the connector of FIG. 1 when seen from the front.
Figure 4:
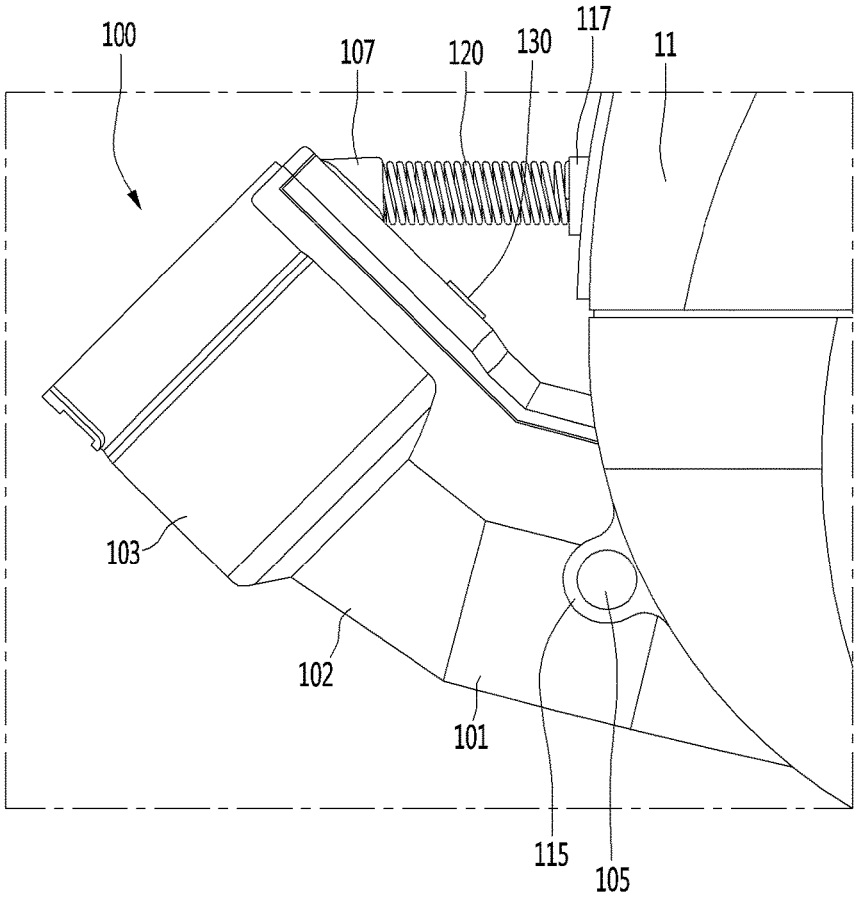
FIG. 4 is a view showing the connector of FIG. 1 when seen from a side.

FIG. 3 is a view showing the connector of FIG. 1 when seen from the front and FIG. 4 is a view showing the connector of FIG. 1 when seen from a side.

Referring to FIGS. 3 and 4, the connector 100 may have a first section 101, a second section 102, and a third section 103. The first section 101 to the third section 103 may be formed in a single tube.

The first section 101, which is directly connected to the body unit 11, extends forward from the body unit 11. The second section 102 may extend forward and incline upward from the first section 101. Accordingly, the first section 101 and the second section 102 can be arranged with a predetermined angle therebetween. The third section 103 extends from the second section 102. The third section 103 has a larger diameter than the first section 101 and the second section 102 so that the connecting hose 23 can be inserted therein.

The connector 100 has an opening 104 that communicates with the connecting hose 23. The opening 104 is connected with the inside of the housing body 11.

The body unit 11 may further have supporting portions 115 that support and allow the connector 100 to turn. The connector 100 may have a rotary shaft 105 coupled to the supporting portions 105. The rotary shaft 105 is inserted and rotatably supported in the supporting portions 105. Accordingly, the connector 100 can turn up and down within a predetermined range. For example, the connector 100 can turn about the rotary shaft 105 that horizontally extends.

The body unit 11 may include a top stopper 113 that limits the backward rotational range (clockwise in FIG. 4) of the connector 100. Further, the body unit 11 may include a bottom stopper 114 that limits the forward rotational range (counterclockwise in FIG. 4) of the connector 100.

The top stopper 113 and the bottom stopper 114 may be integrally formed with the body unit 11.

The cleaner body 10 may further include an elastic member 120 connecting the body unit 11 and the connector 100.

A first fixing portion 117 for fixing an end of the elastic member 120 may be formed at the body unit 11 and a second fixing portion 107

When the connector 100 turns forward, the elastic member 120 is stretched, so a backward return force can be applied to the connector 100. Accordingly, the connector 100 can be turned back to the initial position by the return force from the elastic member 120.

The connector 100 may further include a sensor 130 for sensing movement of the connector 100. The sensor 130 may be disposed at the upper portion of the connector 100, as shown in the figures, but is not limited thereto.

The sensor 130 can detect the current angle and current speed of the connector 100. For example, the sensor 130 may be a common gyro-sensor.

A gyro-sensor, which is a device using the gyro principle that detects an angular speed using a physical phenomenon that when an object that is moving turns, Coriolis force acts perpendicular to the speed direction of the object, accumulates variations from the initial reference position, so it can measure variations of positions and angles as well.

The controller 30 can control rotation of the wheels 12 on the basis of sensing information from the sensor 130. In this specification, controlling rotation of the wheels 12 means controlling operation of the driving motor 32.

A method of controlling the wheels 120 using the controller 30 is described in detail hereafter.

Figure 5:
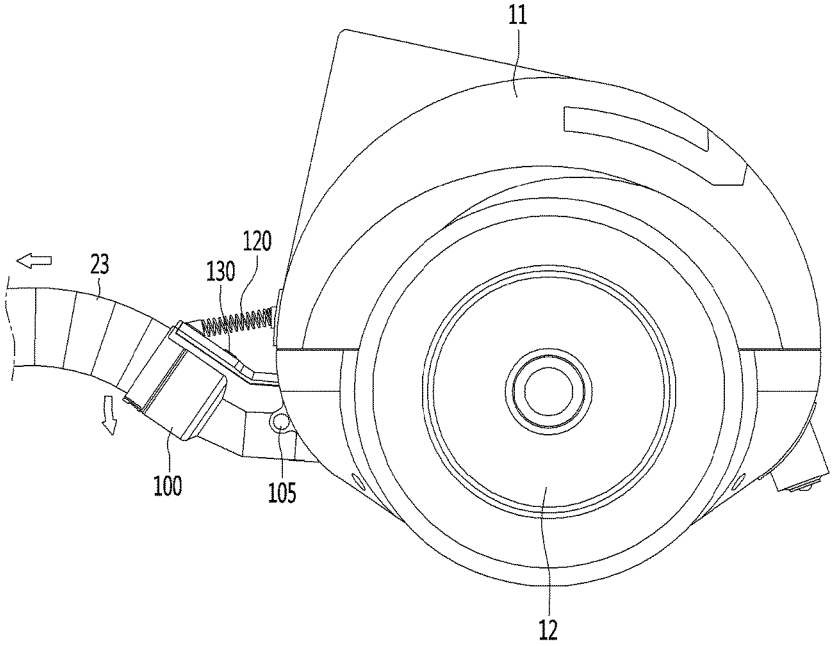
FIG. 5 is a view showing the connector that is turning forward.
Figure 6:
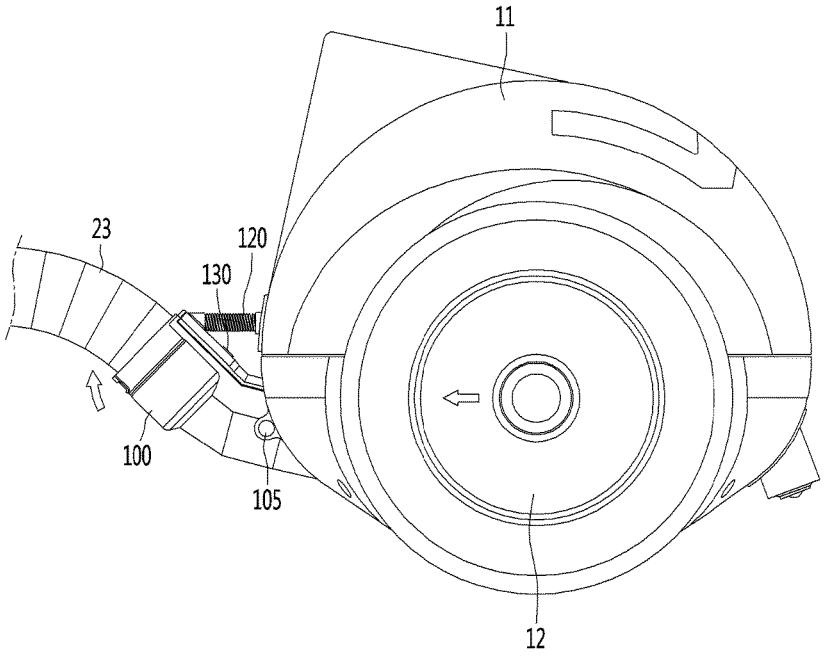
FIG. 6 is a view showing a cleaner body that is moving forward.

FIG. 5 is a view showing the connector that is turning forward and FIG. 6 is a view showing the cleaner body that is moving forward.

Referring to FIGS. 5 and 6, the connector 100 can turn in response to movement of the connecting hose 23.

In detail, when an external force is not applied to the connector 100, the connector 100 maintains the posture inclined forward, but when a forward pulling force is applied through the connecting hose 23, the connector 100 can turn forward about the rotary shaft 105.

When a user does not use the vacuum cleaner 1 (the suction motor turned off), the body unit 11 has been turned forward by the weight of the suction unit 20.

When the user turns on the suction motor 31 and holds the handle 25 in this state, the cleaner body 10 is turned backward, as shown in FIG. 6.

While the cleaner body 10 is turned backward, the connector 100 is turned backward with the cleaner body 10 and the sensor 130 senses the movement of the connector 100. The sensor 130 can detect whether the connector 100 turns by detecting the movement speed of the rotational center of the connector 100.

The controller 30 can determine whether the backward rotational angle of the connector 100 exceeds a reference angle.

The reference angle may be set larger than a backward rotational angle of the cleaner body 10 by a user when the cleaner body 10 is stopped, as shown in FIG. 6.

When the suction unit 20 is moved forward in the state shown in FIG. 6, the connecting hose 23 can also be moved forward. As the connecting hose 23 is moved forward, the connector 100 can be moved with the movement of the connecting hose 23.

When it is sensed that the connector 100 is inclined forward, the controller 30 controls and moves the cleaner body 10 forward. In this process, the controller 30 applies torque to the wheels 12 by controlling the driving motor 32. Accordingly, the wheels 12 can be rotated forward.

When the cleaner body 10 is moved forward, the connector 100 can turn back to the initial position like an inverted pendulum. In this process, the return force of the elastic member 130 is applied to the connector 100, so it can help the connector 100 return to the initial position.

When the connector 100 keeps inclined forward, the controller 30 may continuously apply torque to the wheels 12. The elastic member 130 can solve this problem by immediately returning the connector 100 inclined forward to the initial position.

Meanwhile, as another embodiment, the sensor 130 may be mounted on the connecting hose 23. The position of the sensor 130 can be changed as long as the sensor 130 can sense rotation of the connector 100.

Since the cleaner body 10 is moved forward by the driving motor when a user pulls the suction unit 20 forward, the vacuum cleaner 1 can automatically follow user's movement.

Vacuum cleaners of the related art have automatically followed inclination of the bodies, but according to an embodiment of the present invention, the cleaner body is controlled to automatically follow inclination of the connector 100.

The moment of inertia of the connector 100 is smaller than the moment of inertia of the cleaner body 10. Accordingly, it takes less force to incline the connector 100 rather than the cleaner body 10, so a user can make the cleaner body 10 follow him/her even without applying a large force. Therefore, convenience for the user can be improved.

Figure 7:
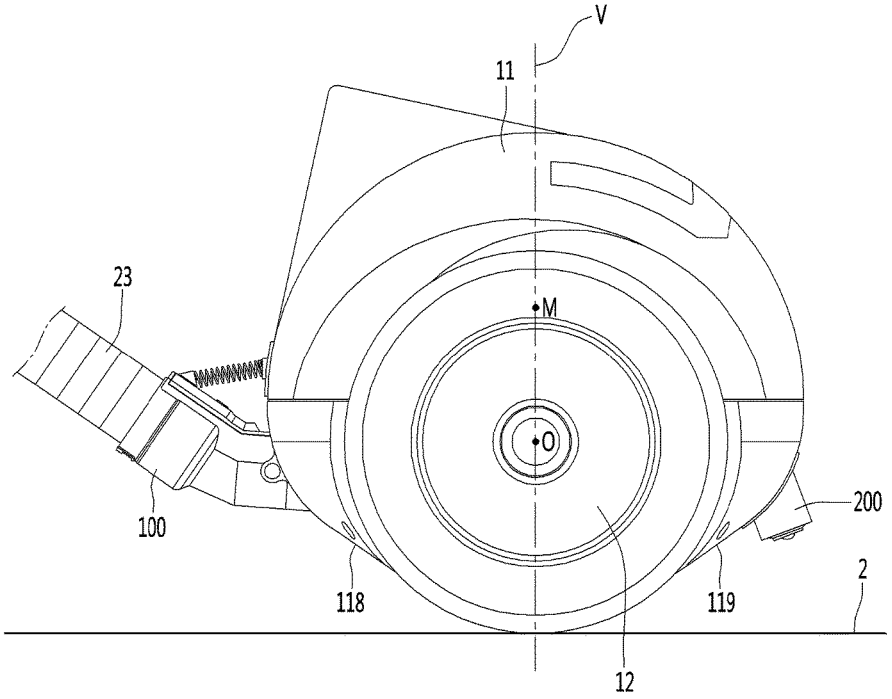
FIG. 7 is a view when the center of gravity of a body unit and the rotational center of wheels are in the same vertical line.

FIG. 7 is a view when the center of gravity of the body unit and the rotational center of the wheels are in the same vertical line.

Referring to FIG. 7, the bottoms 118 and 119 of the cleaner body 10 may be inclined to make a predetermined angle from the floor 2. In detail, the bottoms 118 and 119 of the cleaner body 10 may have a front portion 118 and a rear portion 119. For example, the front portion 118 may make an angle of 20 degrees from the floor 2 and the rear portion 119 may make an angle of 17 degrees from the floor 2. In this specification, the front means the direction facing the connecting hose 23 from the wheels 12 and the rear means the opposite direction of the front.

When the connector 100 is turned forward and the driving motor 32 is operated, the wheels 12 are rotated forward. The wheels 12 may be controlled such that the center of gravity M of the cleaner body 10 is positioned on the vertical line V passing through the rotational center O of the wheels 12 by the forward rotation of the wheels 12.

As the wheels 12 are rotated forward, as shown in FIG. 7, the bottoms 118 and 119 may come off the floor 2.

A control method when the body unit 11 is inclined backward is described with reference to FIG. 8.

Figure 8:
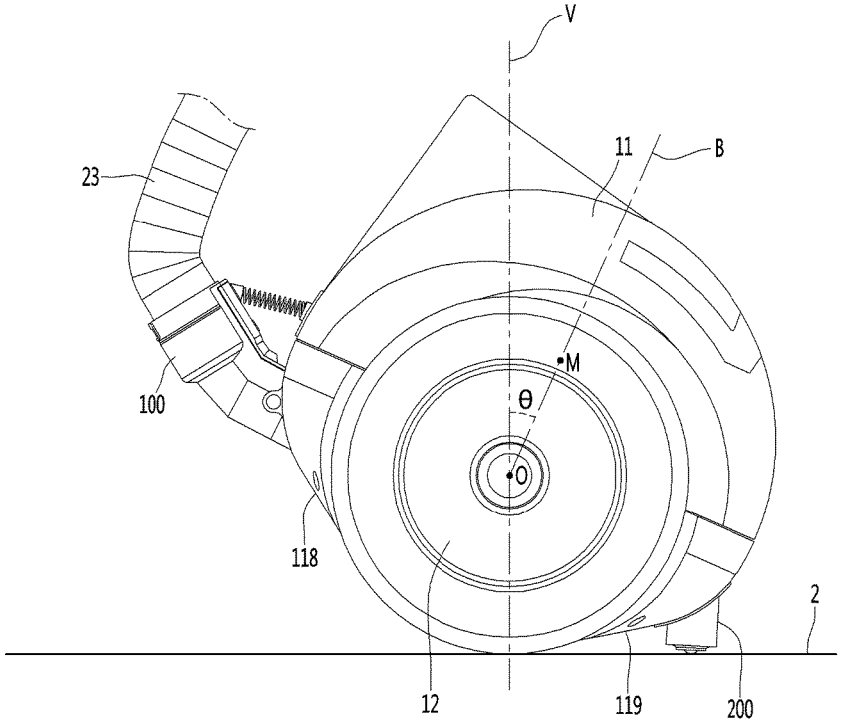
FIG. 8 is a view when the body unit inclines backward.

FIG. 8 is a view when the body unit inclines backward.

Referring to FIG. 8, when a user moves backward the suction unit 20, the cleaner body 10 is correspondingly inclined backward.

As the body unit 11 is inclined backward, the connector 100 is also inclined backward with the body unit 11. As the connector 100 is inclined backward, the sensor 130 senses the backward inclination of the connector 100.

When the body unit 11 has been inclined backward, it means that the center of gravity M of the body unit 11 has been moved backward from the vertical line V.

The controller 30 can control the wheels 12 only when the body unit 11 is inclined at a predetermined angle or more. That is, when the angle θ between the vertical line V and the line B connecting the center of gravity M of the body unit 11 and the rotational center O of the wheels 12 is a predetermined value or more, backward torque may be applied to the wheels 12. The inclination of the body unit 11 may be the same as the backward inclination of the connector 100.

The vacuum cleaner 1 may further include a rear damper 200. The rear damper 200 may be disposed on the rear portion 119 of the bottom of the body unit 11. That is, when the angle θ between the vertical line V and the line B connecting the center of gravity M of the body unit 11 and the rotational center O of the wheels 12 is a predetermined value or more, the rear damper 200 comes in contact with the floor 2.

According to the present invention, when the connector 100 is turned backward, it is a first case in which the connector 100 turns backward with respect to the cleaner body 10 or a second case in which the connector 100 and the cleaner body 10 turn together.

When the connector 100 turns backward with respect to the cleaner body 10, the angular speed sensed by the sensor is different from the angular speed when the connector 100 and the cleaner body 10 turn together.

Accordingly, the controller 30 distinguishes the first case and the second case from each other on the basis of the angular speed sensed by the sensor 130. In the second case, the controller 30 can control the driving motor 32 such that the wheels 12 turn backward when the body unit 11 is inclined backward at a predetermined angle or more.

The rear damper 200 can restrict excessive backward rotation of the body unit 11. Accordingly, it is possible to prevent the body unit 11 form tuning over while a user moves backward.

The detailed structure of the rear damper 200 is described in detail with reference to FIGS. 9 and 10.

Figure 9:
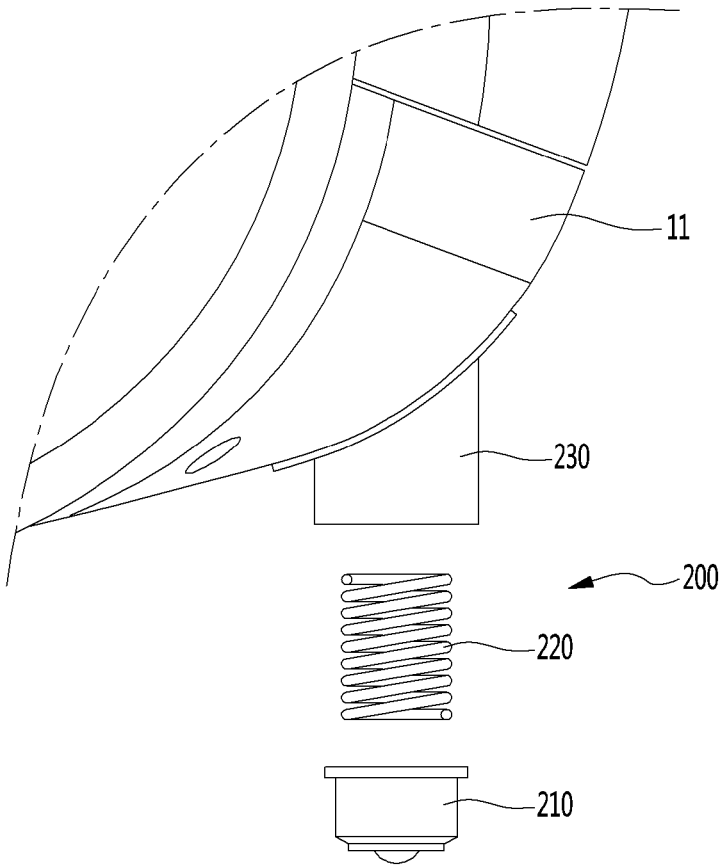
FIG. 9 is an exploded view of a rear damper.
Figure 10:
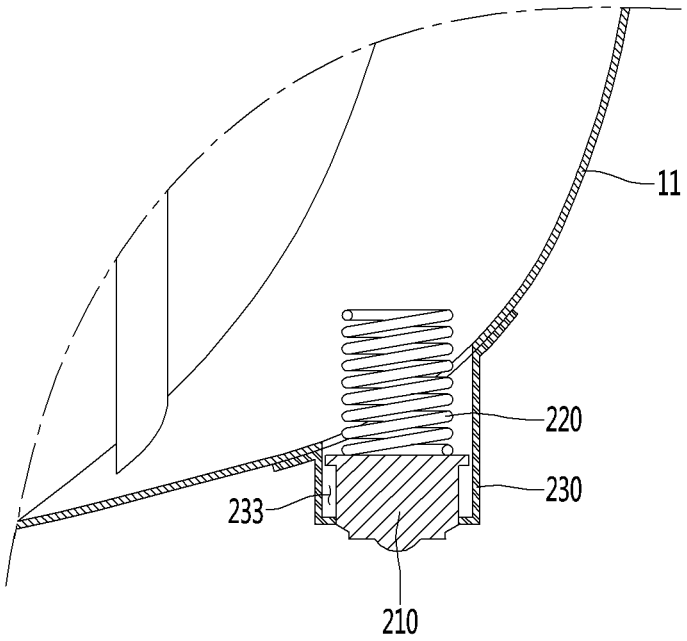
FIG. 10 is a vertical cross-sectional view of the rear damper.

FIG. 9 is an exploded view of the rear damper and FIG. 10 is a vertical cross-sectional view of the rear damper.

Referring to FIGS. 8 to 10, the rear damper 200 includes a contact member 210. The contact member 210 can selectively come in contact with the floor 2.

The rear damper 200 may further include an elastic member 220. A first end of the elastic member 220 is connected to the contact member 210 and can elastically support the contact member 210. A second end of the elastic member 220 may be fixed in the body unit 11. Though not shown in the figures, a fixing portion for fixing the second end of the elastic member 220 may be disposed in the body unit 11.

The rear damper 200 may further include a housing 230 coupled to the body unit 11. An internal space 233 for keeping at least portions of the contact member 210 and the elastic member 220 may be formed in the housing 230.

When the body unit 11 excessively turns backward, the contact member 210 comes in contact with the floor, so it can prevent the body unit 11 from turning over. The contact member 210 can be selectively drawn into the internal space 233 of the housing 230 by the elastic force of the elastic member 220.

Since the elastic member 220 is provided, the shock that is applied to the floor by a rotational force of the body unit 11 can be reduced. Accordingly, it is possible to prevent the rear damper 200 from damaging the floor.

As described above, since the vacuum cleaner 1 of the present invention includes the rear damper 200, it is possible to excessive backward inclination of the body unit 11 during automatic following. Accordingly, it is possible to prevent the body unit 11 from turning over.

Alternatively, the cleaner body 10 may include a switch that is turned on when the contact member 210 is drawn in the internal space 233 of the housing 230 by coming in contact with the floor 2.

When the switch is turned on, the controller 30 can control the driving motor 32 to rotate the wheels 12 backward.

According to an embodiment of the present invention, when the sensor on the connector senses user's intention to move the cleaner body, the wheels are operated by the driving motor, so efforts of a user for moving the cleaner except the effort for cleaning can be reduced.

Further, when the connector is inclined forward, the elastic member immediately returns the connector to the initial position, so excessive movement of the cleaner body can be prevented.

Further, since the rear damper is disposed on the bottom of the body unit, it is possible to restrict excessive rotation of the body unit. Therefore, it is possible to prevent the body unit from turning over.

What is claimed is:

1. A vacuum cleaner comprising:

a cleaner body that includes a suction motor;

wheels that are configured to move the cleaner body;

a driving motor that is configured to drive the wheels;

a suction unit that is configured to communicate with the cleaner body;

a connector coupled to the suction unit, the connector being rotatably connected to the cleaner body;

a connecting hose that connects the suction unit to the connector, the connecting hose being configured to communicate with the suction unit and with the connector;

a sensor that is disposed on the connector and configured to sense a movement of the connector based on rotating together with the connector;

an elastic member that is configured to provide an elastic force to the connector toward an initial position of the connector; and a controller that is configured to control the driving motor based on movement information of the connector sensed by the sensor.

2. The vacuum cleaner of claim 1, wherein the sensor is a gyro sensor disposed on the connector.

3. The vacuum cleaner of claim 1, wherein the connector includes a rotary shaft, and the cleaner body includes a supporting portion that protrudes from the cleaner body and that receives the rotary shaft.

4. The vacuum cleaner of claim 1, wherein the elastic member is configured to provide the elastic force to the connector such that a top surface of the connector turns toward the cleaner body.

5. The vacuum cleaner of claim 4, wherein the cleaner body includes a first fixing portion disposed on a front surface of the cleaner body, the first fixing portion being coupled to a first end of the elastic member, and the connector includes a second fixing portion disposed on the top surface of the connector, the second fixing portion being coupled to a second end of the elastic member.

6. The vacuum cleaner of claim 1, wherein the cleaner body further includes:

a first stopper configured to limit rotation of the connector in a first direction, and a second stopper configured to limit rotation of the connector in a second direction opposite to the first direction.

7. The vacuum cleaner of claim 1, wherein the controller is configured, based on the connector rotating in a first direction in which a top surface of the connector turns away from the cleaner body, to control the driving motor to rotate the wheels in the first direction.

8. The vacuum cleaner of claim 7, wherein the controller is configured to control the driving motor to rotate the wheels in a second direction opposite the first direction based on (i) the connector being oriented to the initial position and (ii) the cleaner body rotating in the second direction by a predetermined angle with respect to a vertical axis.

9. The vacuum cleaner of claim 8, wherein the connector is configured to maintain the initial position relative to the cleaner body while the cleaner body rotates in the second direction.

10. The vacuum cleaner of claim 8, wherein the connector is configured to rotate from the initial position relative to the cleaner body while the cleaner body rotates in the second direction.

11. The vacuum cleaner of claim 1, wherein the cleaner body includes a bottom surface that has a front portion inclined upward toward a front of the cleaner body and a rear portion inclined upward toward a rear of the cleaner body.

12. The vacuum cleaner of claim 11, further comprising a rear damper that is disposed on the rear portion of the cleaner body and configured to contact a floor based on the cleaner body rotating toward the rear of the cleaner body.

13. The vacuum cleaner of claim 12, wherein the rear damper includes:

a housing;

a contact member that is disposed in the housing and configured to contact the floor; and an elastic part that is located within the housing and elastically supports the contact member.

14. The vacuum cleaner of claim 13, wherein the cleaner body further includes a switch that is configured, based on the contact member contacting the floor, to activate a circuit connected to the controller, and the controller is configured, based on the switch activating the circuit, to control the driving motor to rotate the wheels toward the rear of the cleaner body.

15. The vacuum cleaner of claim 12, wherein the rear damper is configured, based on contacting the floor, to restrict rotation of the cleaner body toward the rear of the cleaner body.

16. The vacuum cleaner of claim 1, wherein the cleaner body is configured to rotate about a wheel axis perpendicular to a surface of the wheels.

17. The vacuum cleaner of claim 1, wherein the elastic member is located vertically above a connector axis about which the connector is rotatably connected to the cleaner body.

18. A vacuum cleaner comprising:

a cleaner body that includes a suction motor;

wheels that are configured to move the cleaner body;

a driving motor that is configured to drive the wheels;

a suction unit that is configured to communicate with the cleaner body;

a connector coupled to the suction unit, the connector being rotatably connected to the cleaner body;

a connecting hose that connects the suction unit to the connector, the connecting hose being configured to communicate with the suction unit and with the connector;

a sensor that is disposed on the connecting hose and configured to sense a movement of the connector;

an elastic member that is configured to provide an elastic force to the connector toward an initial position of the connector; and a controller that is configured to control the driving motor based on movement information sensed by the sensor.

19. The vacuum cleaner of claim 18, wherein the controller is configured to control the driving motor based on an angular speed of the connector relative to the cleaner body, the angular speed of the connector being measured by the sensor.

20. A vacuum cleaner comprising:

a cleaner body that includes a suction motor;

wheels that are configured to move the cleaner body;

a driving motor that is configured to drive the wheels;

a suction unit that is configured to communicate with the cleaner body;

a connector coupled to the suction unit, the connector being rotatably connected to the cleaner body;

a sensor that is disposed on the connector and configured to sense a movement of the connector;

an elastic member that is configured to provide an elastic force to the connector toward an initial position of the connector; and a controller that is configured to control the driving motor based on movement information sensed by the sensor, wherein the sensor is a gyro sensor disposed on the connector.

* * * * *